US011459849B1

(12) United States Patent
Zeng et al.

(10) Patent No.: US 11,459,849 B1
(45) Date of Patent: Oct. 4, 2022

(54) FILLING BAG AND SEALING METHOD FOR DRILLED HOLE FOR DETECTION IN THREE ZONES OF OVERBURDEN

(71) Applicants: CHINA UNIVERSITY OF MINING AND TECHNOLOGY, BEIJING, Beijing (CN); Shaanxi Coal Caojiatan Mining Co., Ltd., Yulin (CN)

(72) Inventors: Yifan Zeng, Beijing (CN); Qiang Wu, Beijing (CN); Zhaolai Hua, Beijing (CN); Rui Wang, Beijing (CN); Zhenzhong Pang, Beijing (CN); Lu Wang, Beijing (CN); Yang Lv, Beijing (CN); Xin Du, Beijing (CN); Kai Pang, Beijing (CN); Aoshuang Mei, Beijing (CN)

(73) Assignees: CHINA UNIVERSITY OF MINING AND TECHNOLOGY, BEIJING, Beijing (CN); Shaanxi Coal Caojiatan Mining Co., Ltd., Yulin (CN)

( * ) Notice: Subject to any disclaimer, the term of this patent is extended or adjusted under 35 U.S.C. 154(b) by 0 days.

(21) Appl. No.: 17/730,031

(22) Filed: Apr. 26, 2022

(30) Foreign Application Priority Data

Jun. 8, 2021 (CN) ..... 202110638918.9

(51) Int. Cl.
*E21B 33/13* (2006.01)
*E21B 27/00* (2006.01)
*E21F 17/00* (2006.01)

(52) U.S. Cl.
CPC ..... *E21B 33/13* (2013.01); *E21B 27/00* (2013.01); *E21F 17/00* (2013.01)

(58) Field of Classification Search
CPC ..... E21B 33/13; E21B 27/00; E21F 17/00
See application file for complete search history.

(56) References Cited

U.S. PATENT DOCUMENTS 8,307,916 B1 * 11/2012 Wald ..... E21B 21/003 166/292
2014/0231068 A1 * 8/2014 Isaksen ..... E21B 33/134 166/123
2021/0388684 A1 * 12/2021 Li ..... E21B 33/13

FOREIGN PATENT DOCUMENTS

| | | | |
|---|---|---|---|
| CN | 103075127 A | | 5/2013 |
| CN | 105781607 A | | 7/2016 |
| CN | 106593489 A | | 4/2017 |
| CN | 107044280 A | | 8/2017 |
| CN | 108894727 A | | 11/2018 |
| CN | 109111177 A | * | 1/2019 |
| CN | 110630211 A | | 12/2019 |
| CN | 111734482 A | | 10/2020 |
| GB | 201303089 | | 4/2013 |

OTHER PUBLICATIONS

First Office Action issued in counterpart Chinese Patent Application No. 202110638918.9, dated Nov. 24, 2021.

* cited by examiner

*Primary Examiner* — Caroline N Butcher
(74) *Attorney, Agent, or Firm* — Westbridge IP LLC

(57) ABSTRACT

A sealing method for a drilled hole in three zones of overburden comprises: blocking the fissure zone and the caving zone with at least one filling bag; and transporting prepared cement slurry to the drilled hole through a hollow drill pipe, so as to block the curved subsidence zone. The three zones of overburden comprise a fissure zone, a caving zone and a curved subsidence zone.

7 Claims, 3 Drawing Sheets

FILLING BAG AND SEALING METHOD FOR DRILLED HOLE FOR DETECTION IN THREE ZONES OF OVERBURDEN

CROSS-REFERENCE TO RELATED APPLICATIONS

This application claims priority to Chinese Patent Application CN202110638918.9, filed on Jun. 8, 2021, the entire contents of which are incorporated herein by reference.

TECHNICAL FIELD

The present disclosure relates to the technical field of detection drilling, and in particular, to a filling bag and a sealing method used for a drilled hole for detection in three zones of overburden.

BACKGROUND

As the mining center of mine in China shifts from the central and eastern areas to the west area, the large-scale and high-intensity mining in the west area has brought serious damage to the ecological environment and aquifer structure of the mine. However, the movement and damage of the strata comprising aquifer after mining is the root cause of a series of mine disasters and environmental problems, such as mine surface subsidence, mine water inrush, and ecological environment deterioration. Therefore, it is of great significance to carry out the research on laws of development and evolution of cracks in the overburden strata after mining to curb the occurrence of mine disasters and mine environment problems. In the study of the evolution law of cracks in the overburden strata, the research on the development law of the height of the three zones of overburden in the goaf of the working face is one of the most important means to verify the degree of damage to the overburden comprising aquifer due to mining and to provide a theory support for water-retaining coal mining in similar working faces in the later stage.

On-site detection of the developed height of the three zones of overburden in the goaf is usually achieved by using specially designed observation holes. After the observation is completed, it is required to carry out the full hole sealing treatment to avoid the water body flowing down the hole to the working face and causing mine water hazards. However, in the process of mine excavation, the mine water inrush and sand inrush accident often occur due to the poor sealing of the drilled hole, which brings huge economic losses to the mine. At present, the sealing technologies often used in the mine exploration process mainly include cement slurry sealing, polyurethane sealing, mine sealing device sealing, etc. These technologies have been popularized and applied in a certain period of time, but there are certain deficiencies. For example, when cement slurry seals horizontal or near-horizontal holes, gaps are formed between the mortar precipitation and a drilled hole due to action of gravity, so the sealing effect is not good. In addition, when using cement slurry to seal the drilled holes in three zones of overburden, since there are a large number of cracks in the drilled hole, the slurry will flow into the goaf from the caving zone at the bottom of the hole, so that the hole sealing effect cannot be achieved. External leakage increases the cost of sealing holes. The reaction time of the polyurethane sealing material is fast, and the operation process is easy to cause material waste, environmental pollution, and has a high price; the sealing depth of the sealing device is limited and so on.

SUMMARY

In view of this, the purpose of the present disclosure is to propose sealing aggregate, a filling bag and a sealing method used for a drilled hole for detection in three zones of overburden.

Based on above purpose, the present disclosure provides sealing aggregate for a drilled hole for detection in three zones of overburden, where the three zones of overburden include: a caving zone, a fissure zone, and a curved subsidence zone, and the sealing aggregate includes: stones, aggregate with small grain size, and cement; where a grain size of each stone of the stones is 5-10 mm, and the aggregate with small grain size includes one or more of sand and sawdust.

Optionally, a ratio of the stones, the aggregate with small grain size, and the cement is 5:0.5:2, and the cement is Portland cement with a strength grade of 42.5 R.

The present disclosure also provides a filling bag used for a drilled hole for detection in three zones of overburden, where the filling bag includes the sealing aggregate as described above, and slurry outlet holes are provided on the filling bag.

Optionally, apertures of the slurry outlet holes are set as preset apertures, so that water body in the drilled hole for detection is able to enter the filling bag and cement slurry formed by the water body and the cement in the filling bag is able to flow out from the slurry outlet holes.

Optionally, the preset apertures are smaller than grain sizes of the stones, and the preset apertures are smaller than the grain sizes of the aggregate with small grain size.

Optionally, the filling bag is a cystic filling bag, the filling bag is cylindrical, a diameter of the filling bag is 50 mm, and a height of the filling bag is 120 mm.

Optionally, a number of the slurry outlet holes is more than one, and the slurry outlet holes are evenly distributed around the filling bag.

The present disclosure also provides a sealing method for a drilled hole for detection in three zones of overburden, wherein the sealing method includes: blocking a fissure zone and a caving zone with above-mentioned filling bags; and transporting prepared cement slurry to the drilled hole for detection through a hollow drill pipe, so as to block a curved subsidence zone.

Optionally, the method further includes: injecting a first preset amount of water into the drilled hole for detection after the fissure zone and the caving zone are blocked by the filling bags; or injecting a second preset amount of water into the drilled hole for detection in sections according to a preset sealing length when the fissure zone and the caving zone are blocked by the filling bags.

Optionally, after the fissure zone and the caving zone are blocked by the filling bag, the method further includes: pressing down the filling bags in the fissure zone by the hollow drill pipe in response to determining that there is no water accumulation above the fissure zone within a preset time, and blocking the fissure zone again using the filling bags after the filling bags sink.

As can be seen from above, the sealing aggregate for a drilled hole for detection in the three zones of overburden provided by the present disclosure includes: stones, aggregate with small grain size, and cement; where grain sizes of the stones are 5-10 mm, the aggregate with small grain size includes: one or more of sand and sawdust, so as to prevent the cement slurry from seeping down to goaf through fissures and cannot play the role of blocking the drilled hole due to too large crack section in the caving zone and the fissure zone. At the same time, the sealing aggregate is put into the filling bag for sealing, which can not only completely seal the fissure zone in the hole, but also has effects of simple construction, small amount of engineering, economically and environmentally friendly, and short construction time.

BRIEF DESCRIPTION OF DRAWINGS

In order to illustrate the technical solutions in the present disclosure or related technologies more clearly, the following briefly introduces accompanying drawings used in the description of the embodiments or related technologies. Obviously, the drawings in the following description are only for the present disclosure. In the embodiments, for those of ordinary skill in art, other drawings can also be obtained according to these drawings without any creative effort.

DETAILED DESCRIPTION OF THE EMBODIMENTS

In order to make the objectives, technical solutions and advantages of the present disclosure clearer, the present disclosure will be further described in detail below with reference to the specific embodiments and the accompanying drawings.

It should be noted that, unless otherwise defined, the technical terms or scientific terms used in the embodiments of the present disclosure should have the usual meanings understood by those with ordinary skill in art to which the present disclosure belongs. "first", "second" and similar words used in the embodiments of the present disclosure do not denote any order, quantity or importance, but are only used to distinguish different components. "comprise" or "include" and similar words mean that the elements or things appearing before the word encompass the elements or things recited after the word and their equivalents, but do not exclude other elements or things. Words like "connect" or "associate" are not limited to physical or mechanical connections, but may include electrical connections, whether direct or indirect. Words like "up", "down", "left", "right", etc. are only used to represent the relative positional relationship, and when absolute position of the described object changes, the relative positional relationship may also change accordingly.

Figure 1:
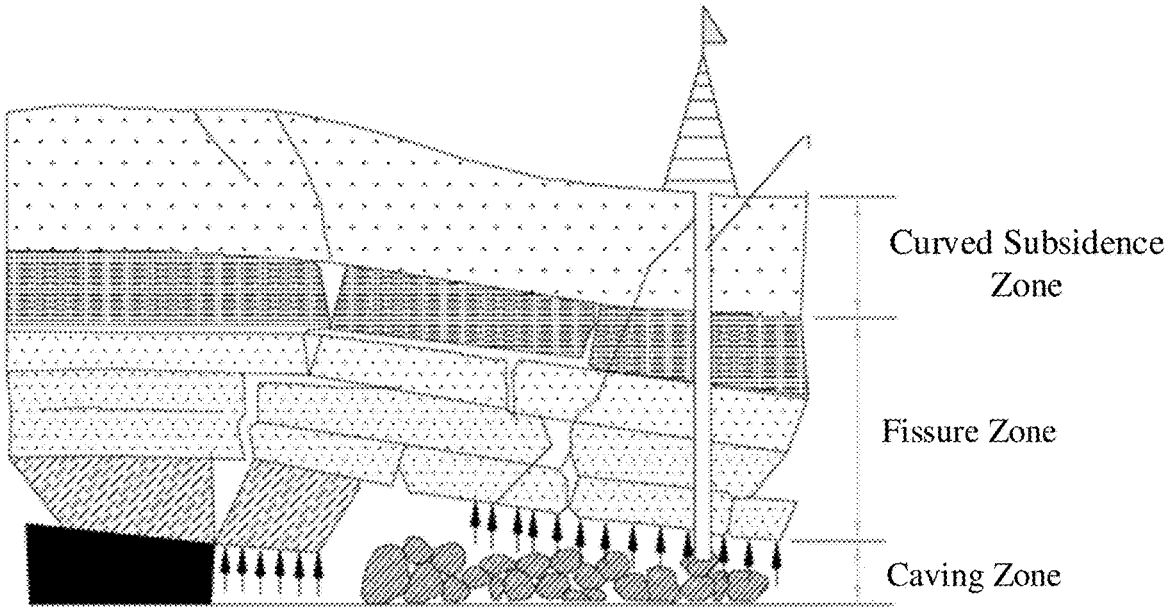
FIG. 1 is a schematic structural diagram of development of overburden strata after high-strength mining of a coal seam according to an embodiment of the disclosure.

As mentioned in the background, referring to FIG. 1, the three zones of overburden from bottom to top are: a caving zone, a fissure zone and a curved subsidence zone. There are a large number of fissures in a drilled hole for detection of the three zones of overburden. If cement mortar is used directly when sealing the hole, the slurry will flow into the goaf from the caving zone at the bottom of the hole, so it cannot play the role of sealing. At the same time, a large amount of slurry leaks out, which increases the cost of sealing. If polyurethane sealing is used, the reaction time of the material is shorter, so the sealing depth is limited. It is easy to cause material waste and environmental pollution during the operation, and the price is high. The present disclosure provides sealing aggregate used for a drilled hole for detection in three zones of overburden, the sealing aggregate comprising: stones, aggregate with small grain size, and cement. The stones are used for support, the aggregate with small grain size is used to fill the gaps between the stones, and the cement is used to form the cement slurry to block the gaps in the fissure zone. At the same time, the present disclosure also divides the sealing step into two steps by detecting the distribution law of the fissures in the hole. The fissures in the hole are first sealed by filling bags, and the filling bags include sealing aggregate composed of stones, aggregate with small grain size, and cement. The filling bags fall into the caving zone in the drilled hole for detection due to gravity and will not flow into the goaf. At the same time, because the drilled hole for detection pass through aquifer, there is dripping water in the hole, and the water enters the filling bags through the slurry outlet holes on the bags and forms cement slurry with the cement in the filling bags, and the cement slurry flows into the fissures on the hole wall through the slurry outlet holes on the filling bags, thereby blocking the fissures in the fissure zone, further ensuring the tightness of the hole sealing. At the same time, this method can not only completely plug the fissures in the hole, but also has the characteristics of simple construction, small amount of engineering, and short construction time. After all the fissures in the hole are sealed, the present disclosure also adopts a method of sealing the hole by moving the drill pipe upward section by section to seal the remaining section of the curved subsidence zone with cement slurry, so as to achieve segmental sealing, which further improves the sealing quality of the drilled hole and reduces the occurrence rate of mine water inrush and sand inrush accidents caused by poor sealing.

Figure 2:
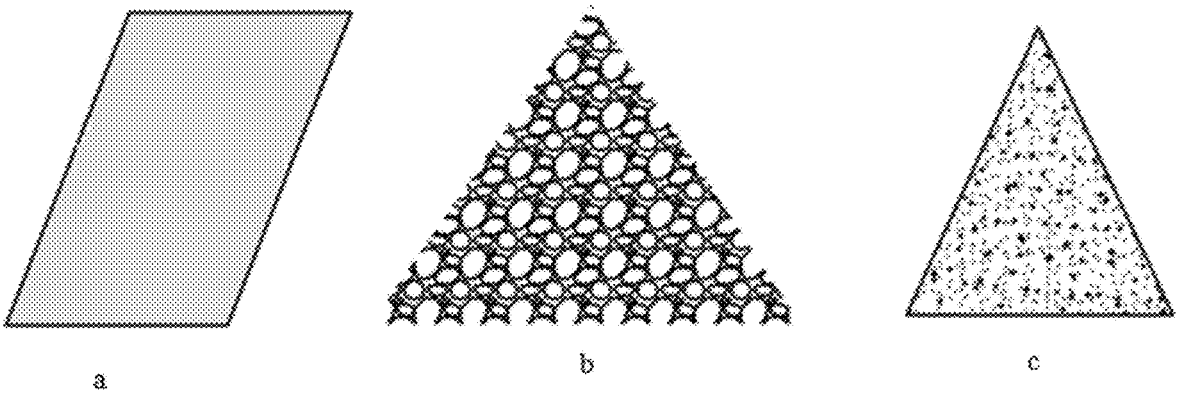
FIG. 2 is a schematic diagram of sealing aggregate used for a drilled hole for detection in three zones of overburden according to an embodiment of the present disclosure.

Referring to FIG. 2, it is a schematic diagram of sealing aggregate used for a drilled hole for detection in three zones of overburden according to an embodiment of the present disclosure. The sealing aggregate includes: stones shown as b, aggregate shown as c with small grain size, and cement shown as a.

The grain size of a stone is 5-10 mm, and the aggregate with small grain size includes one or more of sand and sawdust.

In some embodiments, the aggregate with small grain size may be one or more of sand and sawdust and may also be stones with small grain size or other particles with small grain size. The grain size of the aggregate with small grain size is between the cement and the stone.

In some embodiments, the ratio of stones, aggregate with small grain size, and cement in the sealing aggregate is 5:0.5:2. The cement is ordinary Portland cement with a strength grade of 42.5 R, in which, in the sealing aggregate, the stones play a main role of supporting, and the aggregate with small grain size can fill the gaps between the stones in a filling bag, and the cement is mainly used to form cement slurry with water, to block cracks, and to shape the filling bag when the sealing aggregate is loaded into the filling bag.

Figure 3:
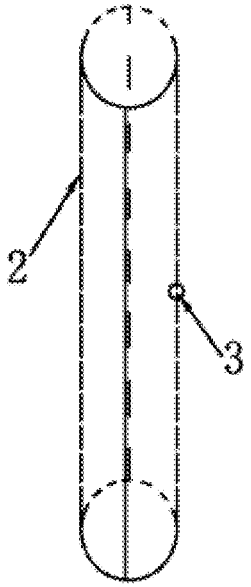
FIG. 3 is a schematic structural diagram of a filling bag used for a drilled hole for detection in three zones of overburden according to an embodiment of the present disclosure.

Referring to FIG. 3, which is a schematic structural diagram of a filling bag for a drilled hole for detection in three zones of overburden according to an embodiment of the present disclosure. A filling bag 2 includes the sealing aggregate as described above, and the filling bag is provided with an outlet hole 3.

Specifically, the filling bag includes sealing aggregate filled in the filling bag. The sealing aggregate includes stones, aggregate with small grain size, and cement. Optionally, the filling bag further includes a sealing tie and a filling opening. The filling opening is used for filling the sealing aggregate into the filling bag. The sealing tie is used to seal the opening of the filling bag after filling the sealing aggregate into the filling bag. The filling bag is provided with a slurry outlet hole, which is used to introduce water into the filling bag and to let the cement slurry flow out through the slurry outlet hole after the cement in the bag and the water form cement slurry, so that the gap between the bags in the drilled hole for detection, the gap between the filling bag and the drilled hole for detection, and cracks in the drilled hole for detection itself can all be blocked, which further ensures the tightness of the hole sealing.

In order to further ensure the effect of hole sealing, in some embodiments, the diameter of the slurry outlet hole is set to a preset diameter, so that the water body in the drilled hole for detection can enter the filling bag and the cement slurry formed by the water body and the cement in the filling bag can flow out from the slurry outlet hole. Optionally, the preset apertures should also satisfy the condition of being smaller than the grain sizes of the stones and smaller than the grain size of the aggregate with small grain size, so as to prevent the stones and the aggregate with small grain size from flowing out of the slurry outlet hole. Optionally, the preset apertures can also satisfy the condition that the cement will not flow out of the slurry outlet hole before the cement slurry is formed.

In some embodiments, referring to FIG. 3, the filling bag is a cystic filling bag, so that when the drilled hole for detection is being blocked, the deformation can be better based on the environment in the hole, so as to improve the tightness of the hole sealing and improve the toughness of the filling bag, thereby preventing the filling bag from being damaged. The filling bag 2 is cylindrical, the diameter of the filling bag 2 is 50 mm, and the height of the filling bag 2 is 120 mm. Optionally, the filling bag can also be in other shapes, such as a cuboid.

In some embodiments, the number of slurry outlet holes can be set as required. Optionally, the number of slurry outlet holes can be set to multiple and evenly distributed around the filling bag, so as to ensure that the cement slurry can flow evenly around the filling bag, thereby ensuring the effect of blocking the fissures.

Based on the same inventive concept, the present invention also discloses a sealing method used for a drilled hole for detection in three zones of overburden. The sealing method comprises:

blocking the fissure zone and the caving zone with the above-mentioned filling bags; and transporting the prepared cement slurry to the drilled hole for detection through a hollow drill pipe, so as to blocking the curved subsidence zone.

Specifically, the above-mentioned filling bag is used to block the fissure zone and the caving zone. It should be noted that because the filling bag will directly fall into the junction of the fissure zone and the caving zone under action of gravity, at the same time, since the sealing aggregate in the filling bag is bulk dry material, it will not agglomerate into lumps, and the drilled hole for detection can be filled with as few gaps as possible, and will not flow into goaf from the caving zone. Optionally, the filling bag can be put into the detection rotary hole through a conveyor or a mechanical manipulator. After the fissure zone and the caving zone are blocked by the filling bag, it is necessary to further block the curved subsidence zone on the fissure zone. Compared with the fissure zone, the curved subsidence zone has fewer cracks and belongs to the outer surface of the drilled hole, therefore it may be blocked by the prepared cement slurry through the hollow drill pipe. Optionally, the water-cement ratio of the prepared cement slurry is 0.5:1, the height of the hollow drill pipe is not more than 4.5 m each time the hole is drilled and sealed, and after the cement delivered for the first time is solidified, the drill is lifted for the second time. The grouting speed of the hollow drill pipe is not more than 0.2 $m^2$/min, and the height from the initial grouting position of the hollow drill pipe to the last put-in bag is 3 m.

In some embodiments, in order to determine the number of filling bags in advance, so that the required filling bags can be filled with sealing aggregate in advance to be ready to use, the sealing method further includes:

detecting the drilled hole for detection by a drilled hole television imager to determine a position of a top interface of the caving zone and a position of a top interface of the fissure zone;

determining a fissure zone length based on the position of the top interface of the caving zone and the position of the top interface of the fissure zone; and determining a number of filling bags required based on the fissure zone length, the diameter of the drilled hole for detection, and a volume of the filling bag.

Specifically, before preparing to seal the hole, the drilled hole for detection is first detected using a drilled hole television imager to determine the position of the top interface of the caving zone and the position of the top interface of the fissure zone; and then the fissure zone length is determined according to the position of the top interface of the caving zone and the position of the top interface of the fissure zone.

The number of filling bags required is determined based on the fissure zone length, the diameter of the drilled hole for detection, and the volume of the filling bag. Optionally, the volume of the drilled hole in the fissure zone is first calculated according to the fissure zone length and the diameter of the drilled hole for detection, and then divide the volume of the drilled hole in the fissure zone by the volume of the filling bag to determine the number of the filling bags required. The bag is elastic, so when the final determined number of filling bags is not an integer, the decimal part can be directly rounded up to a whole number. Optionally, if the diameter of the filling bag is 50 mm and the height of it is 120 mm, the number a of the filling bags is related to aperture b of the drilled hole for detection and the fissure zone length c, and the quantitative relationship is $a=(b/50)*(c/120)$. Since the filling bag has a certain degree of expansion, when the relationship between the aperture of the drilled hole for detection and the diameter of the filling bag is not an integer multiple, that is, when b/50 is not an integer, an integer is directly taken. For example, the aperture of the drilled hole for detection is 133 mm, the diameter of the filling bag is 50 mm, then the number of filling bags is 3, and so on. When the relationship between the fissure zone length and the height of the filling bag is not an integer multiple, that is, when c/60 is not an integer, the integer is directly taken. For example, the height of the water fissure zone is 2300 mm, the height of the filling bag is 120 mm, then the number of filling bags is 20, and so on.

In order to further ensure that the filling bags can be smoothly lowered into the drilled hole for detection along the hole wall, in some embodiments, the plurality of sealed filling bags are lowered into the drilled hole for detection one by one along the hole wall after the drilled hole for detection is cleaned with water, so that the drilled hole for detection is as clean as possible without obvious obstacles.

In order to ensure that the fissure zone can be completely blocked, the position of the top interface of the fissure zone can be determined by a drilled hole video imager, and when the height from an accumulative height of the filling bags in the drilled hole for detection to the top interface of the fissure zone is greater than a preset height, the feeding of the filling bags into the drilled hole for detection is stopped. The preset height can be set as required, mainly to ensure that the filling bags can completely block the fissure zone. Optionally, the preset height can be set as 10 m.

In order to further ensure the sealing effect of the filling bags, in some embodiments, the method further includes:

injecting a first preset amount of water into the drilled hole for detection after the fissure zone and the caving zone are blocked by the filling bags; or injecting a second preset amount of water into the drilled hole for detection in sections according to a preset sealing length when the fissure zone and the caving zone are blocked by the filling bags.

Specifically, under normal circumstances, the drilled hole for detection in the three zones of overburden passes through the water barrier, so there will be water droplets in the drilled hole for detection, and these water droplets will fall on the filling bags and form cement slurry with the cement in the filling bags. However, due to the difference in amount of dripping water in different drilled holes for detection, when amount of dripping water is very small, the cement slurry may have solidified before it flows out of the slurry outlet holes well, thereby affecting the sealing effect. Therefore, a method of active water injection can be used to ensure that the cement slurry can flow out from the slurry outlet holes. The method of active water injection specifically includes: injecting a first preset amount of water into the drilled hole for detection after the fissure zone and the caving zone are blocked by the filling bags. The first preset amount can be obtained according to experiments, and the first preset amount is mainly used to ensure that the cement slurry can flow out of the filling bag and solidify just in the fissures around the filling bag. Further, considering the effect of water injection to prevent the cement in the lowermost filling bag from being solidified before water injection, it is possible to inject a second preset amount of water into the drilled hole for detection in sections according to a preset sealing length when the fissure zone and the caving zone are blocked by the filling bags. The preset length can be set as required, the second preset amount can also be obtained through experiments, and the specific effect is the same as the first preset amount. Since the second preset amount belongs to multiple water injection amounts, the second preset amount is smaller than the first preset amount. Optionally, a second preset amount of water may also be injected into the drilled hole for detection according to a preset time period.

In some embodiments, after the fissure zone and the caving zone are blocked by the filling bags, the method further includes:

pressing down the filling bags in the fissure zone by the hollow drill pipe in response to determining that there is no water accumulation above the fissure zone within a preset time, and blocking the fissure zone again using the filling bags after the filling bags sink.

Specifically, since there is dripping water in the drilled hole for detection, under normal circumstances, these dripping water will flow into the goaf along the drilled hole for detection, but after the hole is sealed, the channel through which the dripping water normally flows into the goaf will be blocked, resulting in water accumulation. Therefore, it can be determined whether the fissure zone is tightly sealed by judging whether there is water accumulation on the filling bag that was put in last. If there is water accumulation, it means that the sealing is very successful, that is, the sealing is tight. If there is no water accumulation within the preset time, it means that the sealing is not very tight at this time and dripping water can flow down from a leaking hole of the sealing so that water accumulation will not be formed. At this time, it is very likely that one or more filling bags are suspended, which affects the sealing effect, so at this time, the filling bags in the fissure zone are pressed down by the hollow drill pipe, and after the filling bags sink, the filling bags are placed along the wall of the hole to further ensure the effect of sealing.

Figure 4:
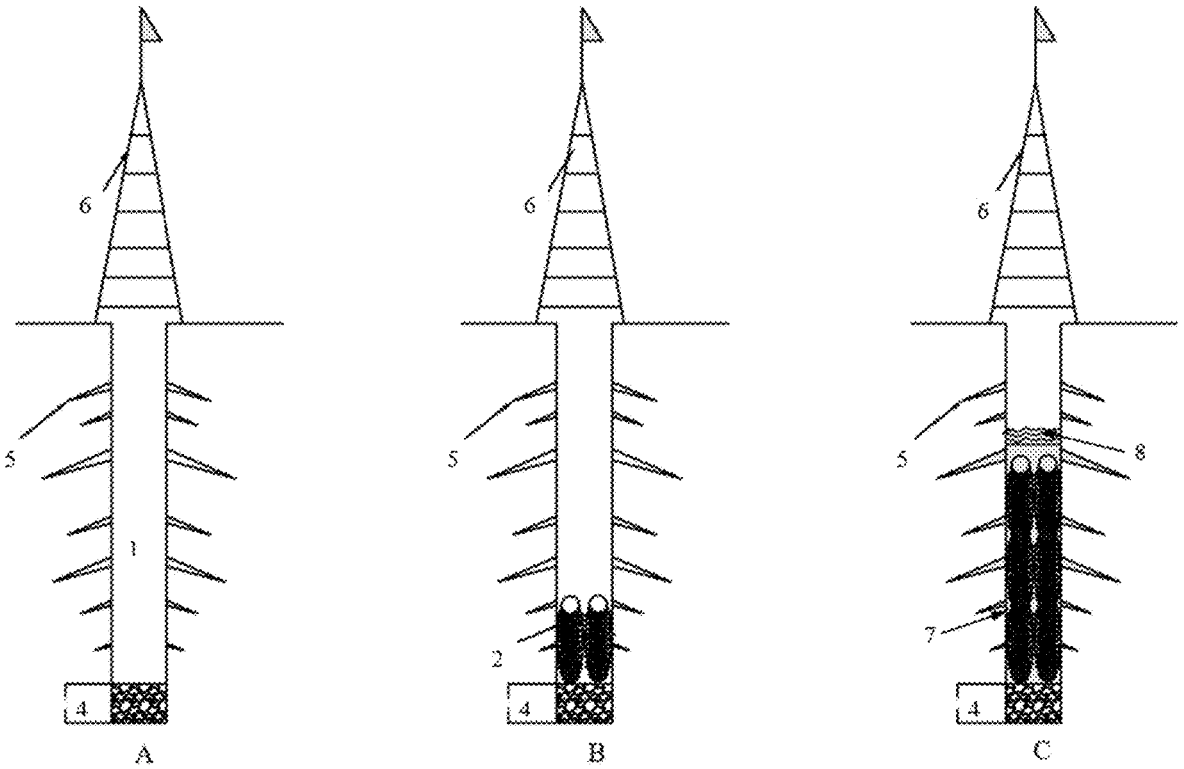
FIG. 4 is a schematic structural diagram of a drilled hole for detection with filling bags being lowered therein according to an embodiment of the disclosure.

Referring to FIG. 4, which is a schematic structural diagram of a drilled hole for detection with filling bags being lowered therein according to an embodiment of the present disclosure, 6 represents a drilling rig tower, 5 represents a fissure in the drilled hole for detection. A is a schematic structural diagram of the drilled hole 1 for detection when filling bags 2 haven't been lowered into the drilled hole 1 for detection, B is a schematic structural diagram of the drilled hole 1 for detection when the filling bags 2 start to be lowered into the drilled hole 1 for detection, and C is a schematic structural diagram of the drilled hole 1 for detection after the fissure zone is blocked by the filling bags 2. When the filling bags 2 are not lowered to the drilled hole 1 for detection, the caving zone 4 has a plurality of cracks leading to the goaf. When the filling bags 2 start to be lowered into the drilled hole 1 for detection, under the action of gravity, the filling bags 2 fall on top of the caving zone 4, and the caving zone 4 is blocked. As the filling bags 2 are continuously lowered, the water in the hole enters the filling bags 2, and forms cement slurry with the cement in the filling bags 2. The agglomerated cement slurry 7 is formed, through the slurry outlet holes on the filling bags 2, at the wall of the drilled hole for detection. When the filling bags 2 are used to block the fissure zone, water accumulation 8 will be formed above the filling bags 2. At this time, the fissure zone is tightly blocked. It can be seen from C in FIG. 4 that all the fissures in the fissure zone are blocked by the cement slurry after the fissure zone is blocked with the filling bags 2, and the cement slurry, due to the function of the filling bags, will not directly flow into the goaf through the caving zone.

Figure 5:
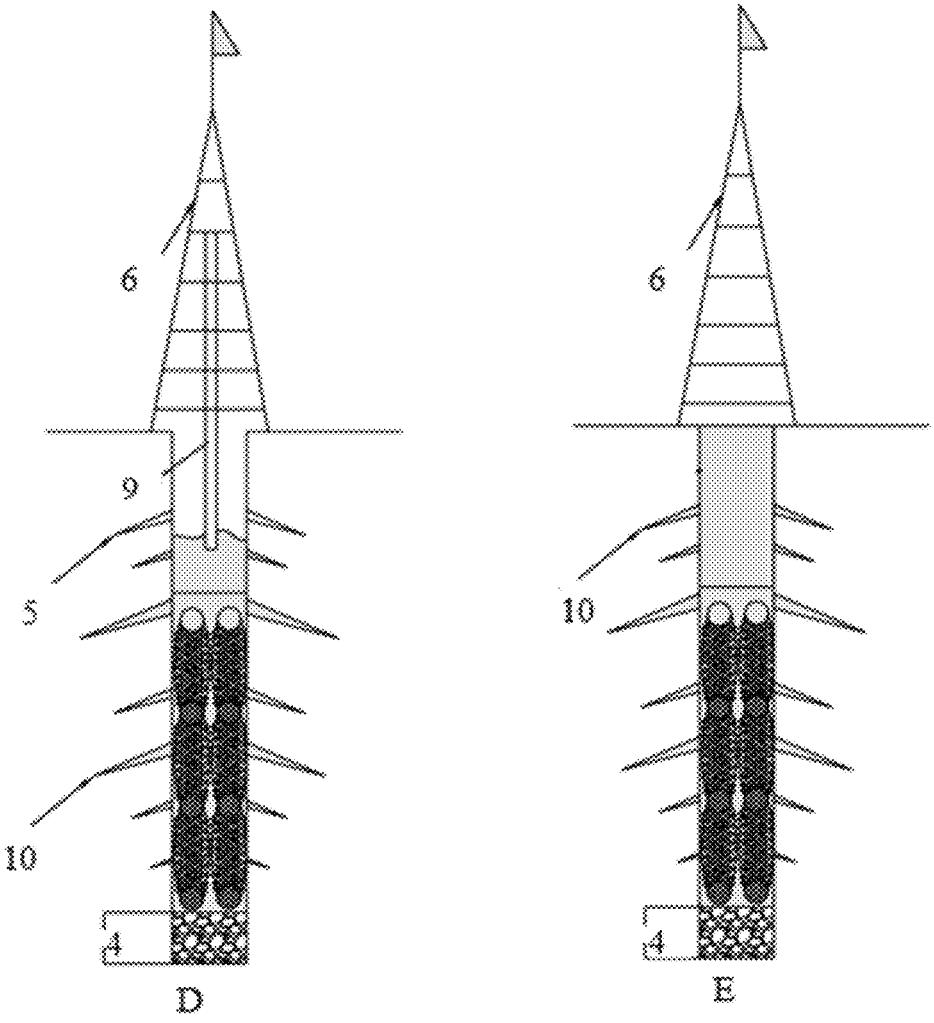
FIG. 5 is a schematic structural diagram of a drilled hole into which cement slurry is poured using a hollow drill pipe according to an embodiment of the present disclosure.

Referring to FIG. 5, which is a schematic structural diagram of a drilled hole for detection filled with cement slurry according to an embodiment of the present disclosure, 6 represents a drilling rig tower, 9 represents a hollow drill pipe, and 5 represents a fissure in the drilled hole for detection, 10 represents the fissure in the drilled hole for detection that has been blocked, 4 represents the caving zone. D is the schematic structural diagram of the drilled hole for detection when blocking the curved subsidence zone by the hollow drill pipe using the cement slurry is started, and E is the schematic structural diagram of the drilled hole for detection when blocking the curved subsidence zone by the hollow drill pipe using the cement slurry is stopped.

In the present disclosure, the hole sealing step is divided into two steps by detecting the distribution law of the fissures in the drilled hole for detection. First, the fissures in the drilled hole for detection are sealed by filling bags. This method can not only block the fissures in the hole, but it also has the characteristics of simple construction, small amount of engineering, and short construction time. After all the internal fissures of the fissure zone of the drilled hole for detection are completely sealed, a method of sealing the hole by moving the drill pipe upward section by section is adopted to seal the curved subsidence zone using cement slurry. The segmented two-step flexible sealing method proposed in the present disclosure can not only improve the sealing quality of the drilled hole and reduce the occurrence rate of mine water inrush and sand inrush accidents caused by poor sealing, but also has advantages of high sealing quality, simple operation, economically and environmentally friendly, and good safety features. In particular, application of the sealing method of the present disclosure is of great significance in detecting the development law of fissures in the overburden rocks in high-strength mining areas in the west.

It should be noted that, the methods of the embodiments of the present disclosure may be executed by a single device, such as a computer or a server. The method in this embodiment can also be applied in a distributed scenario and is completed by the cooperation of multiple devices. In the case of such a distributed scenario, one device among the multiple devices may only perform one or more steps in the method of the embodiment of the present disclosure, and the multiple devices will interact with each other to complete the above-mentioned method.

It should be noted that some embodiments of the present disclosure are described above. Other embodiments are within the scope of appended claims. In some cases, actions or steps recited in the claims can be performed in an order different from that in above-described embodiments and still achieve desirable results. Additionally, the processes depicted in the figures do not necessarily require the particular order shown, or sequential order, to achieve desirable results. In some embodiments, multitasking and parallel processing are also possible or may be advantageous.

It should be noted that the embodiments of the present disclosure can also be further described in the following ways.

It should be understood by those of ordinary skill in art that the discussion of any of above embodiments is only exemplary and is not intended to imply that the scope of the present disclosure (including the claims) is limited to these examples. Under the spirit of the present disclosure, above embodiments or technical features in different embodiments may also be combined, steps may be implemented in any order, and there are many other variations of the different aspects of the disclosed embodiments as described above, which are not provided in detail for the sake of brevity.

Additionally, to simplify illustration and discussion, and in order not to obscure the embodiments of the present disclosure, well-known power/power sources associated with integrated circuit (IC) chips and other components may or may not be shown in the figures provided in the figures provided. ground connection. Furthermore, devices may be shown in block diagram form in order to avoid obscuring the disclosed embodiments, and this also takes into account the fact that details regarding the implementation of these block diagram devices are highly dependent on the implementation of the disclosed embodiments platform (i.e., these details should be well within the understanding of those skilled in art). Where specific details (e.g., circuits) are set forth to describe exemplary embodiments of the present disclosure, it will be apparent to those skilled in the art that the disclosed embodiments may be practiced without these specific details or with these specific details. Accordingly, these descriptions are to be regarded as illustrative rather than restrictive.

Although the present disclosure has been described in conjunction with specific embodiments thereof, many alternatives, modifications, and variations to these embodiments will be apparent to those of ordinary skill in art from the foregoing description. For example, other memory architectures (e.g., dynamic RAM (DRAM)) may use the discussed embodiments.

The disclosed embodiments are intended to cover all such alternatives, modifications and variations that fall within the broad scope of appended claims. Therefore, any omission, modification, equivalent replacement, improvement, etc. made within the spirit and principle of the embodiments of the present disclosure should be included within the protection scope of the present disclosure.

What is claimed is:

1. A sealing method for a drilled hole in three zones of overburden, wherein, the three zones of overburden comprise a fissure zone, a caving zone and a curved subsidence zone; the method comprising:

blocking the fissure zone and the caving zone with at least one filling bag;

wherein, each of the at least one filling bag comprises sealing aggregate and slurry outlet holes on it; the sealing aggregate comprises: stones, aggregate with small grain size, and cement; grain sizes of the stones are 5-10 mm, and the aggregate with small grain size comprises: one or more of sand and sawdust; apertures of the slurry outlet holes are set as preset apertures, so that a water body in the drilled hole is able to enter the at least one filling bag and cement slurry formed by the water body and the cement in the at least one filling bag is able to flow out from the slurry outlet holes; and transporting prepared cement slurry to the drilled hole through a hollow drill pipe, so as to block the curved subsidence zone.

2. The sealing method according to claim 1, further comprising:

injecting a first preset amount of water into the drilled hole after the fissure zone and the caving zone are blocked by the at least one filling bag; wherein, the first preset amount of water is obtained according to experiments to ensure that cement slurry flow out of the at least one filling bag and solidify in fissures around the at least one filling bag; or injecting a second preset amount of water into the drilled hole in sections according to a preset sealing length when the fissure zone and the caving zone are blocked by the at least one filling bag; wherein, the second preset amount of water is obtained according to experiments to ensure that cement slurry flow out of the at least one filling bag and solidify in fissures around the at least one filling bag, and the second preset amount of water is smaller than the first preset amount of water.

3. The sealing method according to claim 1, after blocking the fissure zone and the caving zone with the at least one filling bag, further comprising:

pressing down the at least one filling bag in the fissure zone by the hollow drill pipe in response to determining that there is no water accumulation above the fissure zone within a preset time, and blocking the fissure zone again using other filling bags after the at least one filling bag sinks.

4. The sealing method according to claim 1, wherein a ratio of the stones, the aggregate with small grain size, and the cement in weight is 5:0.5:2, and the cement is Portland cement with a strength grade of 42.5 R.

5. The sealing method according to claim 1, wherein the preset apertures are smaller than the grain sizes of the stones, and the preset apertures are smaller than a grain size of the aggregate with small grain size.

6. The sealing method according to claim 1, wherein each of the at least one filling bag is cylindrical, a diameter of each of the at least one filling bag is 50 mm, and a height of each of the at least one filling bag is 120 mm.

7. The sealing method according to claim 1, wherein a number of the slurry outlet holes is more than one, and the slurry outlet holes are evenly distributed around the at least one filling bag.

* * * * *